US009366509B2

(12) United States Patent
Connolly

(10) Patent No.: US 9,366,509 B2
(45) **Date of Patent: *Jun. 14, 2016**

(54) ARCHERY ARROW HAVING IMPROVED FLIGHT CHARACTERISTICS

(71) Applicant: Aldila Golf Corp., Poway, CA (US)

(72) Inventor: Martin Connolly, San Marcos, CA (US)

(73) Assignee: Aldila Golf Gorp., Poway, CA (US)

( * ) Notice: Subject to any disclaimer, the term of this patent is extended or adjusted under 35 U.S.C. 154(b) by 88 days.

This patent is subject to a terminal disclaimer.

(21) Appl. No.: 14/531,063

(22) Filed: Nov. 3, 2014

(65) Prior Publication Data

US 2015/0051030 A1 Feb. 19, 2015

Related U.S. Application Data

(62) Division of application No. 13/306,966, filed on Nov. 29, 2011, now Pat. No. 8,876,640.

(60) Provisional application No. 61/417,726, filed on Nov. 29, 2010.

(51) Int. Cl.
*F42B 6/04* (2006.01)
*F42B 10/00* (2006.01)

(52) U.S. Cl.
CPC .. *F42B 6/04* (2013.01); *F42B 10/00* (2013.01)

(58) Field of Classification Search
CPC ..... F42B 6/04
See application file for complete search history.

(56) References Cited

U.S. PATENT DOCUMENTS 1,648,376 A 11/1927 Blodgett
1,913,810 A 6/1933 Lannes, Sr.
2,288,562 A 6/1942 Birkhofer et al.
2,525,332 A 10/1950 Alger et al.
2,723,426 A 11/1955 Pelley
4,204,307 A 5/1980 Pfetzing
4,210,330 A 7/1980 Kosbab
4,558,868 A 12/1985 Musacchia
4,645,211 A 2/1987 Beiter
4,706,965 A 11/1987 Schaar
4,801,151 A 1/1989 Sturm et al.
4,829,974 A 5/1989 Anderson (Continued)

OTHER PUBLICATIONS

Tim Dehn, "Gold Tip Arrow Production Bounces Back from Involuntary Plant Closure", Arrow Trade Magazine, United States.

(Continued)

*Primary Examiner* — John Ricci
(74) *Attorney, Agent, or Firm* — Gary L. Eastman, Esq.

(57) ABSTRACT

The archery arrow having improved flight characteristics of the present invention is designed to improve the accuracy of the arrow which is equipped with a dampening medium within the central bore of the arrow shaft. The dampening materials in an embodiment may include, but not be limited to, silicon, epoxies or urethanes and selection of various dampening materials may provide for varying degrees of stiffness. The dampening effects of internal dampening materials decrease the initial deflection distance of the arrow and also serves to decrease the deflection with each oscillation. In addition, the dampening medium adopted in the present invention provides for an arrow having a selectable center of gravity location that has improved flight characteristics. Thus, the dampening materials adopted in the present invention provide for a selected location of center of gravity and a desired attenuation of oscillations.

20 Claims, 3 Drawing Sheets

(56) References Cited

U.S. PATENT DOCUMENTS

| | | | | |
|---|---|---|---|---|
| 4,874,180 | A | 10/1989 | Fingerson et al. | |
| 4,905,397 | A | 3/1990 | Juelg, Jr. | |
| 4,943,067 | A | 7/1990 | Saunders | |
| 5,154,432 | A | 10/1992 | Saunders | |
| 5,234,220 | A | 8/1993 | Schellhammer et al. | |
| 5,265,872 | A | 11/1993 | Tennent et al. | |
| 5,273,293 | A | 12/1993 | Lekavich | |
| 5,338,177 | A | 8/1994 | Le Touche | |
| 5,417,439 | A | 5/1995 | Bickel | |
| 5,516,117 | A | 5/1996 | Rangel | |
| 5,895,331 | A * | 4/1999 | Rinehart | 473/578 |
| 6,017,284 | A | 1/2000 | Giles | |
| 6,251,036 | B1 | 6/2001 | Wu et al. | |
| 6,364,499 | B1 | 4/2002 | Jones | |
| D456,700 | S | 5/2002 | Miller et al. | |
| 6,530,865 | B2 | 3/2003 | Held | |
| 6,554,725 | B1 | 4/2003 | Schaar | |
| 6,554,726 | B2 | 4/2003 | Thurber | |
| 6,595,868 | B1 * | 7/2003 | Androlia | 473/318 |
| 6,612,947 | B2 | 9/2003 | Porter | |
| 6,959,868 | B2 | 11/2005 | Tsikos et al. | |
| 6,974,398 | B2 * | 12/2005 | Murphy | 473/578 |
| 7,004,859 | B2 | 2/2006 | Palomaki et al. | |
| 7,077,770 | B2 | 7/2006 | Palomaki et al. | |
| 7,115,055 | B2 | 10/2006 | Palomaki et al. | |
| 7,270,618 | B2 | 9/2007 | Palomaki et al. | |
| 7,331,886 | B2 | 2/2008 | Morris et al. | |
| 7,374,504 | B2 | 5/2008 | Palomaki et al. | |
| 7,578,801 | B2 | 8/2009 | Weststrate et al. | |
| 7,608,001 | B2 | 10/2009 | Palomaki et al. | |
| D605,499 | S | 12/2009 | Gaudron | |
| 7,651,421 | B2 | 1/2010 | Smith et al. | |
| 7,686,714 | B2 | 3/2010 | Smith et al. | |
| D628,056 | S | 11/2010 | Busch | |
| 7,824,171 | B2 | 11/2010 | Hanson et al. | |
| 8,057,330 | B2 | 11/2011 | Blosser et al. | |
| 8,230,748 | B2 | 7/2012 | Wang et al. | |
| 8,241,156 | B2 | 8/2012 | Sims et al. | |
| 8,262,518 | B2 | 9/2012 | Palomaki et al. | |
| 8,388,473 | B2 | 3/2013 | Smith | |
| 8,475,303 | B2 | 7/2013 | James | |
| 2003/0166425 | A1 | 9/2003 | Sutherland et al. | |
| 2006/0281593 | A1 | 12/2006 | Young | |
| 2008/0085793 | A1 | 4/2008 | Palomaki et al. | |
| 2009/0163308 | A1 | 6/2009 | Odabachian et al. | |
| 2009/0291785 | A1 | 11/2009 | Smith | |
| 2009/0291786 | A1 | 11/2009 | Liao | |
| 2010/0113195 | A1 | 5/2010 | Rezmer | |
| 2011/0172040 | A1 | 7/2011 | Belcik | |
| 2012/0021856 | A1 | 1/2012 | Mackey, Jr. et al. | |
| 2012/0028741 | A1 | 2/2012 | Palomaki et al. | |
| 2013/0288831 | A1 | 10/2013 | James | |

OTHER PUBLICATIONS

Patrick Meitin, "Fat or Thin, Arrow Suppliers Have 3D Shooters Covered", Arrow Trade Magazine, Jan. 2007, United States.

* cited by examiner

ARCHERY ARROW HAVING IMPROVED FLIGHT CHARACTERISTICS

CROSS REFERENCE TO RELATED APPLICATION

This application is a divisional of, and claims priority to and the benefit of U.S. patent application Ser. No. 13/306,966 for "Archery Arrow Having Improved Flight Characteristics," filed on Nov. 29, 2011 and currently co-pending, which claims the benefit of priority to U.S. Provisional Patent Application for "Archery Arrow Having Improved Flight Characteristics," Ser. No. 61/417,726, filed on Nov. 29, 2010, and the disclosure is incorporated fully herein by reference.

BACKGROUND OF THE INVENTION

1. Field of the Invention

The present invention relates generally to archery arrows, and more specifically to techniques for improving the flight characteristics of the arrow. The present invention is more particularly, though not exclusively useful as improving the accuracy of the arrow by adopting an internal dampening material which provides for the minimization of the oscillation and the selective placement of the center of gravity of an arrow.

2. Description of the Related Art

Modern arrows are typically made from a carbon fiber arrow shaft that is hollow, and include a point in the front of the arrow shaft, a nock in the rear of the arrow shaft, and fletching along the surface of the arrow shaft adjacent the nock. In flight, the hollow arrow shaft flexes slightly along its length in an oscillatory motion. Specifically, the action of shooting the arrow from the bow creates a lateral deflection along the length of the arrow which oscillates. This oscillatory motion, coupled with the natural rotation of the arrow due to the fletching, results in an imperfect flight of the arrow. In some cases, the flight can be disrupted sufficiently by the oscillation such that the arrow misses the intended target. Thus, minimization of the oscillatory motion of an arrow improves the accuracy of the arrow.

Another characteristic of archery arrows that impacts flight is the placement of the center of gravity of the arrow. In cases where hunting points are used, the center of gravity will be far forward in the arrow. In other circumstances, the point may be light, creating an arrow having a center of gravity far back in the arrow. Often, the location of the center of gravity of an arrow is an aspect of personal preference for the shooter, so the ability to select the location of this would be advantageous so as to provide an archer with the capability to match the point weight, the arrow, and the location of the center of gravity for each arrow used.

In light of the above, it would be advantageous to provide an arrow that is capable of adaptation to minimize oscillations during flight, as well as adjust the positioning of the center of gravity of an arrow.

SUMMARY OF THE INVENTION

The archery arrow having improved flight characteristics of the present invention is designed to improve the accuracy of the arrow by incorporating an internal dampening material into the arrow. An improved arrow is provided that is equipped with a dampening medium within the central bore of the arrow shaft.

In a preferred embodiment, the dampening materials may include, but not be limited to, silicon, epoxies or urethanes and these materials may at least partially solidify once positioned within lumen and maintain the position along the length of the shaft. Selection of various dampening materials may provide for varying degrees of stiffness. Dampening material in the lumen can extend a distance within shaft, where the distance may vary depending on the weight that is desired to be added to the arrow and the amount of desired effects of dampening. The dampening material may be placed throughout the entire length of the shaft, or only a portion of the shaft, or at multiple locations. In addition, the dissimilar dampening materials can also be equipped into the arrow in the present invention.

The dampening effects of internal dampening materials decrease the initial deflection distance of the arrow and also serves to decrease the deflection with each oscillation. This also provides for an arrow having a selectable center of gravity location, as well as an arrow that has improved flight characteristics through the minimization of unwanted deflections and oscillations. Therefore, by selectively including a variety of dampening materials in a single arrow shaft, an arrow having highly customizable mechanical and flight characteristics can be devised through the present invention.

BRIEF DESCRIPTION OF THE DRAWINGS

The nature, objects, and advantages of the present invention will become more apparent to those skilled in the art after considering the following detailed description in connection with the accompanying drawings, in which like reference numerals designate like parts throughout, and wherein.

DETAILED DESCRIPTION OF THE INVENTION

Figure 1:
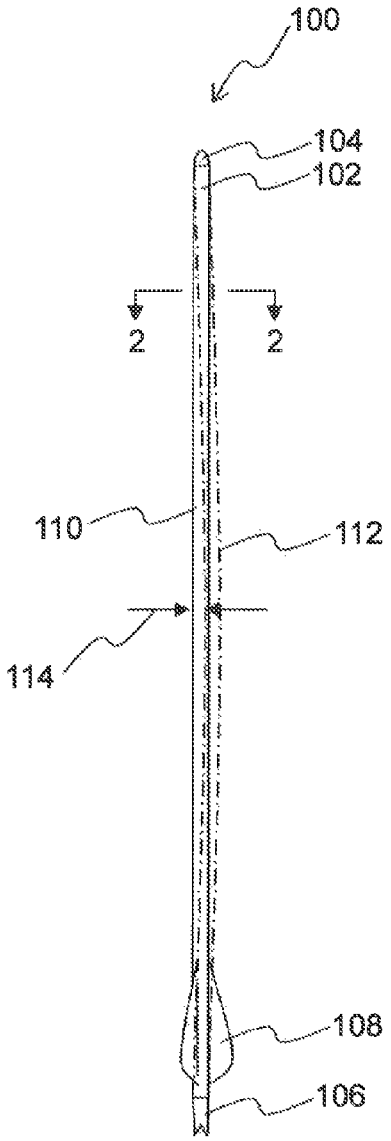
FIG. 1 is a diagrammatic view of an arrow in the present invention, with an illustration of laterally flexed arrow, when it is shot.

An improved arrow is provided that is equipped with a dampening medium within the central lumen, or bore, of the arrow shaft. Referring to FIG. 1, an arrow 100 is provided and includes an arrow shaft 102 fitted with a point 104 at its front end, a nock 106 at its rear end, and fletching 108 positioned on the outer surface of shaft 102 adjacent nock 106. As the arrow 100 is shot from a bow (cross or compound), the shaft 102 flexes laterally from a straight position 110 to a deflected position 112. Specifically, the arrow shaft 102 bends along its length so as to deflect a distance 114. Due to the flexible and resilient nature of the shaft 102, this deflection distance oscillates as the arrow 100 flies through the air to a target.

Figure 2:
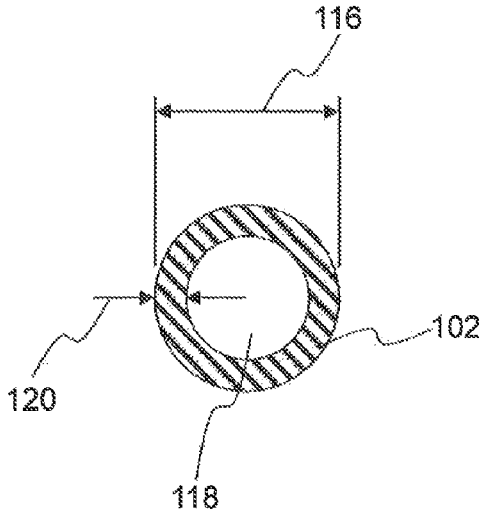
FIG. 2 is a cross-sectional view taken along lines 2-2 of FIG. 1.

FIG. 2 is a cross-sectional view taken along lines 2-2 of FIG. 1, showing the tubular nature of the shaft 102. As shown, shaft 102 has an outer diameter 116 and is formed with a central lumen 118. The wall thickness 120 may vary depending on the weight and rigidity of the shaft 102. In some cases, the wall thickness may be greater; however, this arrow will be heavier due to the increase in shaft material. In a preferred embodiment, shaft 102 is made from a carbon fiber or as is known in the art. These shafts have an inherent flexibility due to the materials and manufacturing, and can result in an arrow having significant deflection 114. As stated above, the amplitude of this deflection 114 can significantly affect the flight characteristics of the arrow 100.

Figure 3:
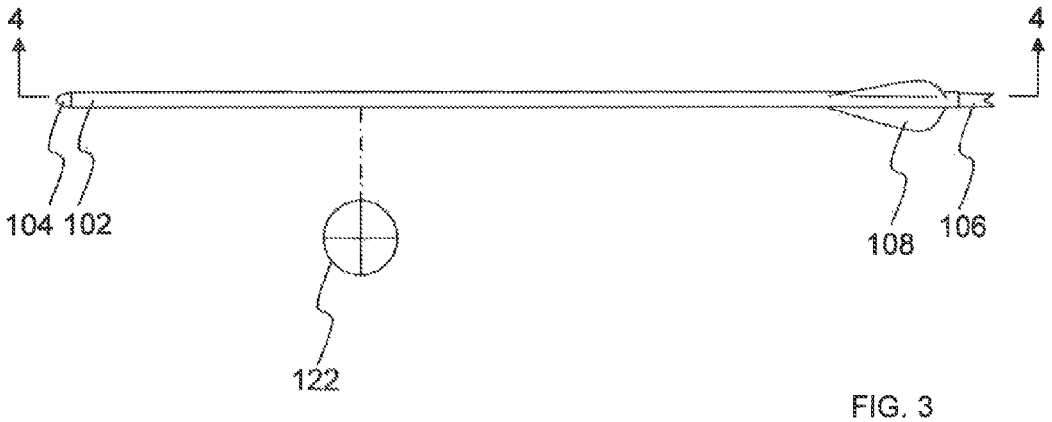
FIG. 3 is a diagrammatic view of an arrow in the present invention, showing the center of gravity of it.

An arrow will have a typical center of gravity. For instance, referring to FIG. 3, the center of gravity 122 is shown in the front half of the arrow 100. The positioning of the center of gravity 122 along arrow 100 will be determined by the weights of shaft 102, the point 104, nock 106 and fletching 108.

Figure 4:
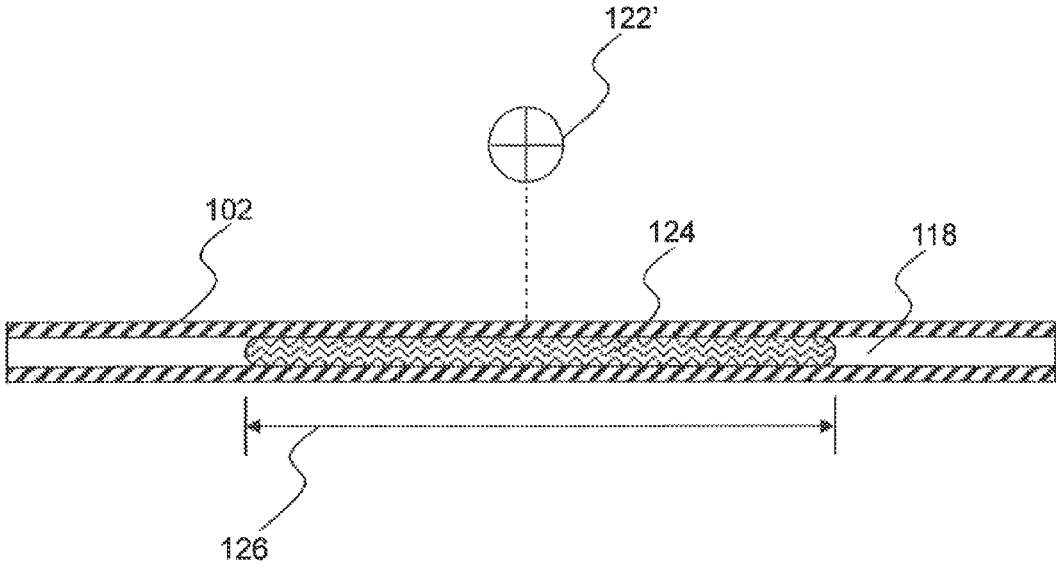
FIG. 4 is a cross-sectional view of an arrow taken along lines 4-4 of FIG. 3.

The arrow of the present invention 100 is equipped with an internal dampening material which provides for the minimization of the deflection 114, the dampening of any deflection 114, and the selective placement of the center of gravity 122 along the length of the arrow shaft 102. Referring to FIG. 4, a cross-sectional view of arrow 100 as taken along lines 4-4 of FIG. 3, dampening material 124 is shown in lumen 118 and extends a distance 126 within shaft 102. As can be appreciated, distance 126 may vary depending on the weight that is desired to be added to the arrow 100, and the amount of dampening that is desired. For instance, if only a small adjustment to the center of gravity 122' is desired, a small amount of dampening material 124 may be added. This would necessarily have a minimal effect on the dampening function for the arrow 100. Alternatively, a significant shift in the center of gravity 122' may be created by adding a larger amount of dampening material 124 to lumen 118 of arrow 100.

The dampening material 124 may be placed throughout the entire length of the shaft 102, or through only a portion of the shaft. Lumen 118 may be filled with multiple dampening materials 124, and such multiple dampening materials 124 may be of similar or dissimilar materials. For instance, the portion of the lumen adjacent the point may be filled with a first dampening material, and the portion of the lumen adjacent the nock may be filled with a second dampening material. The first and second dampening materials may be the same or dissimilar to achieve a desired dampening effect on shaft 102. The shaft-stiffening and dampening effects of the material 124 provides for the deflections and oscillations in arrow 100 to diminish as the arrow flies towards its target.

Figure 5:
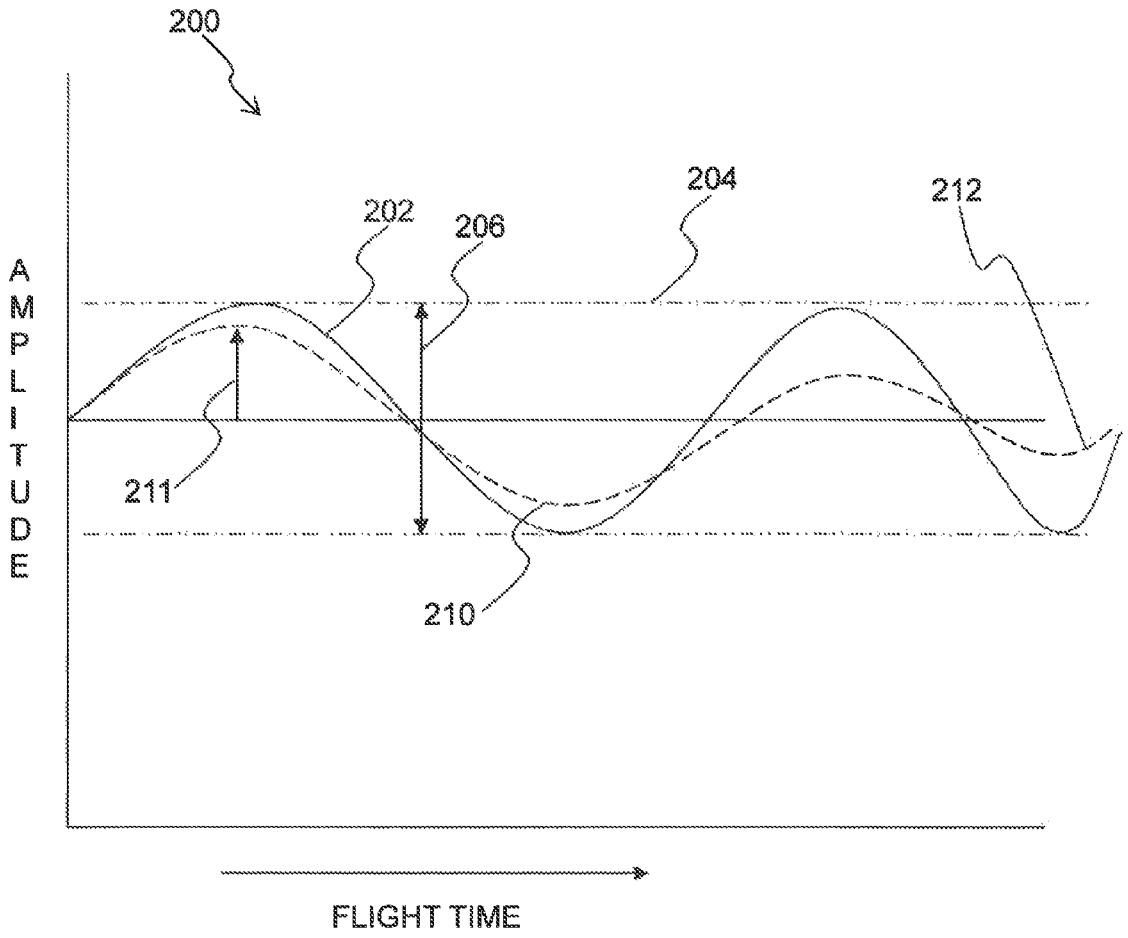
FIG. 5 is a graphical representation of the deflection and oscillation of the arrow shaft in the present invention.

Referring to FIG. 5, a graphical representation of the deflection and oscillation of the arrow shaft 102 is shown. Specifically, graph 200 includes a representative graph of the amplitude of deflection as a function of flight time. This graphical representative is merely exemplary of a preferred embodiment, and represents one embodiment; the deflection and dampening can be adjusted by the addition and placement of dampening materials 124.

Graph 200 includes a first oscillating curve 202 representing an arrow that is not equipped with the present invention. Specifically, curve 202 has a maximum deflection 204, and a consistent amplitude of deflection 206 representing an undampened oscillation of the shaft of an arrow during its entire flight. Curve 210 (shown in dashed lines) represents the arrow 100 of the present invention has a higher stiffness and thus has an initial deflection of 211, which diminishes through flight to a lesser amplitude shown as 212. The dampening effects of dampening materials 124 decrease the initial deflection distance 211 of arrow 100, and also serves to decrease the deflection with each oscillation. This provides for an arrow 100 having a selectable center of gravity location, as well as provides for an arrow that has improved flight characteristics through the minimization of unwanted deflections and oscillations.

Graph 200 indicates that the frequency of deflections within arrow 100 is similar to those of an ordinary arrow not equipped with the dampening materials of the present invention. However, it is to be appreciated that the selection of various dampening materials will provide for a change in the amplitude and periodicity of the oscillations experience by the arrow 100. For instance, dampening materials having a higher viscosity may decrease the frequency of oscillations, and dampening materials having a lower viscosity may provide for faster oscillations. Also, selection of various dampening materials may provide for varying degrees of stiffness, in which a dampening material 124 having a higher stiffness will result in lower deflections 114, while dampening material 124 having a lower stiffness may result in greater deflections 114.

In a preferred embodiment, dampening materials 124 may include, but not be limited to, silicon, epoxies or urethanes. These materials may at least partially solidify once positioned within lumen 118 and maintain the position along the length of shaft 102. In other cases, the dampening materials may remain viscous, with a sufficient viscosity to maintain the position of the material within the length of arrow shaft 102.

It is also to be appreciated that the arrow of the present invention may be equipped with multiple locations of dampening materials 124 within lumen 118. For instance, a length 126 of dampening materials 124 may be positioned forward in the arrow 100 to provide a center of gravity 122 near the point 104, and a second length of dampening material 124 near fletching 108 to provide a selected location of center of gravity, and a desired attenuation of oscillations.

It is also to be appreciated that the arrow 100 of the present invention may include dampening materials 124 of dissimilar material. For instance, a low viscosity light weight material may be positioned in lumen 118 between two separate placements of dampening materials of higher viscosity or weight. Thus, by selectively including a variety of dampening materials 124 in a single arrow shaft 102, an arrow having highly customizable mechanical and flight characteristics can be devised using the present invention.

What is claimed is:

1. An archery arrow having improved flight characteristics comprising:

an arrow shaft having a length and an outer diameter and formed with a central lumen;

a plurality of dampening materials placed within said central lumen along said length of said arrow shaft wherein said plurality of dampening materials comprises at least two different types of dissimilar dampening materials; and wherein said plurality of dampening materials are positioned within said lumen to achieve a desired center of gravity.

2. The archery arrow of claim 1, wherein said plurality of dampening material fills at least a portion of said length of said lumen.

3. The archery arrow of claim 2, wherein each of said plurality of dampening materials is each applied along said length of said shaft within said lumen wherein said plurality of dampening materials is applied at multiple locations within said lumen.

4. The archery arrow of claim 3, wherein said plurality of dampening materials is applied within said lumen to achieve a predetermined weight.

5. The archery arrow of claim 3, wherein each of said plurality of dampening materials is applied at different locations along said length of said shaft within said lumen to achieve a predetermined stiffness.

6. The archery arrow of claim 3, wherein each of said plurality of dampening materials is applied at different locations along said length of said shaft within said lumen to achieve a predetermined dampening.

7. The archery arrow of claim 3 further comprising: a point; a nook; and fletching.

8. An archery arrow having improved flight characteristics comprising:

an arrow shaft having a length and an outer diameter and formed with a central lumen;

a first dampening material placed within said central lumen along said length of said arrow shaft;

a second dampening material place within said central lumen along said length of said arrow shaft, said second dampening material and said first dampening material are dissimilar; and wherein said first dampening material and said second dampening material are positioned within said lumen to achieve a desired center of gravity.

9. The archery arrow of claim 8, wherein said first dampening material and said second dampening material fills at least a portion of said length of said lumen.

10. The archery arrow of claim 9, wherein said first dampening material and said second dampening material is applied at different locations along said length of said shaft within said lumen.

11. The archery arrow of claim 10, wherein said first dampening material and said second dampening material is added to achieve a predetermined weight.

12. The archery arrow of claim 10, wherein said first dampening material and said second dampening material is applied at different locations along said length of said shaft within said lumen to achieve a predetermined stiffness.

13. The archery arrow of claim 10, wherein said first dampening material and said second dampening material is applied at different locations along said length of said shaft within said lumen to achieve a predetermined dampening.

14. The archery arrow of claim 10 further comprising: a point; a nook; and fletching.

15. The archery arrow of claim 10 further comprising a third dampening material placed within said central lumen along said length of said arrow shaft.

16. The archery arrow of claim 15, wherein said third dampening material fills at least a portion of said length of said lumen.

17. The archery arrow of claim 16, wherein said third dampening material, said second dampening material and said first dampening material is applied at different locations along said length of said shaft within said lumen.

18. The archery arrow of claim 15 further comprising a fourth dampening material placed within said central lumen along said length of said arrow shaft.

19. The archery arrow of claim 18, wherein said fourth dampening material fills at least a portion of said length of said lumen.

20. The archery arrow of claim 19, wherein said fourth dampening material, said third dampening material, said second dampening material and said first dampening material is applied at different locations along said length of said shaft within said lumen.

* * * * *